US006647991B2

(12) United States Patent
Silva

(10) Patent No.: US 6,647,991 B2
(45) Date of Patent: Nov. 18, 2003

(54) MULTIPLE CLIP HAIR FASTENER

(76) Inventor: David Alan Silva, 2314 Lafayette St., Santa Clara, CA (US) 95050

( * ) Notice: Subject to any disclaimer, the term of this patent is extended or adjusted under 35 U.S.C. 154(b) by 0 days.

(21) Appl. No.: 10/133,068

(22) Filed: Apr. 26, 2002

(65) Prior Publication Data

US 2002/0117183 A1 Aug. 29, 2002

Related U.S. Application Data

(63) Continuation-in-part of application No. 09/795,913, filed on Feb. 27, 2001.

(51) Int. Cl.[7] ..... A45D 8/00

(52) U.S. Cl. ..... 132/273; 132/277; 132/279; 132/145; 2/174; 24/338

(58) Field of Search ..... 132/273, 275, 132/276, 277, 278, 279, 144, 145, 146, 101, 57.1, 60, 63.1, 64.1, 201, 203, 207; 2/174, DIG. 11; D28/27, 32, 33, 42; 24/338, 331, 332

(56) References Cited

U.S. PATENT DOCUMENTS 290,365 A * 12/1883 Smith ..... 132/101
694,934 A * 3/1902 Machado ..... 132/145
1,345,216 A * 6/1920 Narbett ..... 24/66.4
1,624,449 A * 4/1927 Van Sickle et al. ..... 132/275
2,065,903 A * 12/1936 Levy ..... 24/332
2,428,985 A * 10/1947 O'Neil ..... 132/146
2,454,642 A * 11/1948 Finman ..... 132/141
3,412,739 A * 11/1968 Thatcher ..... 132/278
5,862,814 A * 1/1999 Janik et al. ..... 132/275
5,894,848 A * 4/1999 Schach ..... 132/223
6,098,636 A * 8/2000 Curtiss et al. ..... 132/277
6,237,611 B1 * 5/2001 LeCronne et al. ..... 132/275

* cited by examiner

*Primary Examiner*—Eduardo C. Robert
*Assistant Examiner*—David C. Comstock

(57) ABSTRACT

A multiple clip fastener for securing sections of hair of a human being in rows and for aligning hair clips. The apparatus is a semicircle headband, retaining comb, or barrette that has a plurality of hair clips integrally attached and aligned longitudinally along their top. In use, the headband, retaining comb, or barrette is attached to the hair and hair sections are neatly aligned and secured in rows to the multiple clip fastener by placing each corresponding hair section into corresponding hair clip. Each clip remains aligned with each other and the multiple clip hair fastener is removable and reusable.

10 Claims, 6 Drawing Sheets

MULTIPLE CLIP HAIR FASTENER

This application is a continuation-in-part and discloses and claims subject matter disclosed in my earlier filed pending application, Ser. No. 09/795,913 filed Feb. 27, 2001.

BACKGROUND OF THE INVENTION

1. Field of the Invention

The present invention and method relates to a multiple clip hair fastener. More particularly a headband, retaining comb, or barrette with a plurality of hair clips integrally attached to their top for keeping hair sections in rows and hair clips aligned.

2. Description of Prior Art

Many people like to put their hair up in various styles. One way to put the hair up is to twist a plurality of sections of hair around the face and secure them with hair clips. This process is effective and stylish but it is difficult for a non-hairstylist to achieve, especially when trying to align each hair section with the previous and trying to keep the clips in alignment. It is also a time consuming process.

SUMMARY OF THE PRESENT INVENTION

An object of the present invention is to provide an instrument which is convenient, practical, and inexpensive for use in hair styling.

A further object is to provide an instrument that will keep a plurality of hair clips neatly aligned.

A further object is to provide a single instrument that will keep a plurality of hair sections in neatly aligned rows.

A further object is to provide such an instrument that can be used unassisted by the individual styling their hair, eliminating the expense of a professional stylist.

A further object is to provide an instrument that can be reused over and over again.

A further object is to provide an instrument that will quickly hold the user's hair up in a neatly secured style.

According to one aspect of the present invention, there is provided a multiple clip hair fastener comprising a flexible headband with a plurality of clips integrally attached to its top. The clips stand substantially perpendicular to the band and close at their open end.

According to the arrangement described above the headband is placed on the user's head. The user then twists tiny sections of hair, directly in front or behind each clip, and places the section into the corresponding clip. Because all the clips are integrally attached and aligned the twisted hair sections remain in conveniently spaced apart rows and the clips don't move out of alignment.

Accordingly a preferred embodiment of the headband is a semicircle shape made of plastic with a plurality of hair clips integrally attached and aligned longitudinally along the semicircle headband top. The clips stand substantially perpendicular to the band and close at their open end.

According to another aspect of the present invention, there is provided a multiple clip hair fastener comprising a retaining-comb with a plurality of clips integrally attached to its top. The clips stand substantially perpendicular to the band and close at their open end.

Accordingly in a preferred embodiment of the comb version of the present invention the retaining-comb is plastic and slightly arched to conform to the user's head with a plurality of hair clips integrally attached and aligned longitudinally along the base of the retaining comb. The clips stand substantially perpendicular to the retaining comb and close at their open end.

According to another aspect of the present invention, there is provided a multiple clip hair fastener comprising a barrette with a plurality of hair clips integrally attached to its top. The clips stand substantially perpendicular to the band and close at their open end.

Accordingly in a preferred embodiment of the barrette version of the present invention the barrette is a standard metal barrette with a hinge on one end and a latch at the other. A plurality of hair clips is integrally attached and is aligned longitudinally along the base of the barrette. The clips stand substantially perpendicular to the barrette and close at their open end.

According to another aspect of the present invention, there is provided a multiple clip hair fastener comprising a plurality of clips attached to each other at each clip's bottom leg, forming a multiple clip hair fastener of the present invention.

Accordingly the preferred embodiments of the attached clip version have each bottom leg of the hair clips either removably snapped to the next, hinged together, or the bottom leg could simply be a continuous bar like the original multiple-clip fastener of which this is a continuation-in-part from, however the band is smaller, instead of a semicircle headband, and acts more as a multiple clip barrette.

Other objects, features and advantages of the present invention will become apparent from the following description of the preferred embodiments given with reference to the accompanying drawings.

BRIEF DESCRIPTION OF THE DRAWINGS

In the accompanying drawings

DETAILED DESCRIPTION OF THE PREFERRED EMBODIMENTS

Figure 1:
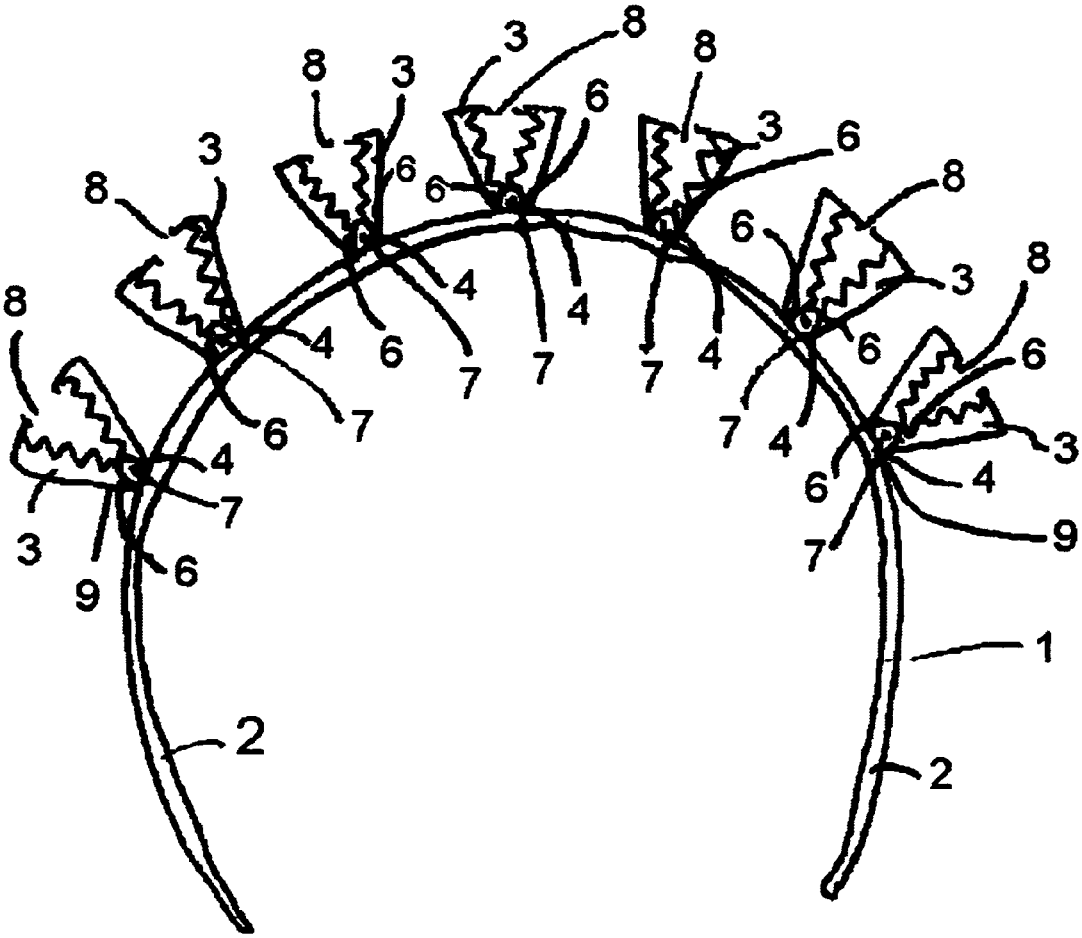
FIG. 1 is a front view showing a multiple clip fastener according to the present invention.
Figure 2:
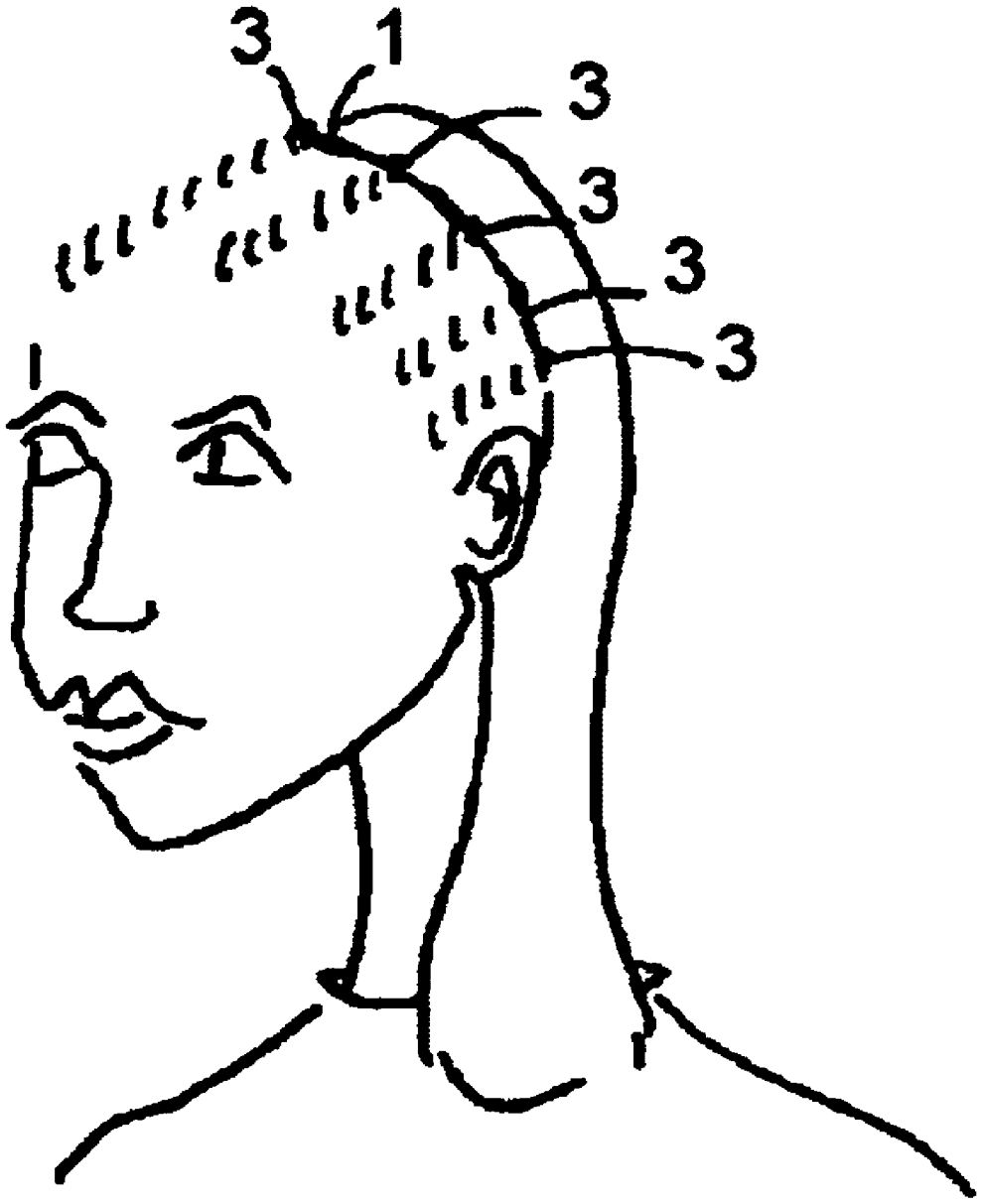
FIG. 2 is a schematic view showing the multiple clip fastener secured to the user's hair.

Referring to FIGS. 1 and 2 of the accompanying drawings, there is illustrated a multiple clip headband fastener, generally designated by reference numeral 1, embodying the present invention. The semicircle headband fastener 1 comprises a first band portion 2 and a plurality of clip portions 3. Each band portion 2 has a plurality of lug portions 4 and each lug portion 4 has a hole 5. Each clip has two lugs 6 that correspond to lugs 4 and lugs 6 have holes 7 that correspond to holes 5. The semicircle portion 2 and the clip portions 3 are made of plastic. The clip portions 3 stand substantially vertical to the band and close at their open end 8. In assembly two clip portions 3 are placed on top each of lugs 4 while aligning lugs 6 with lugs 4. A pin 9 is placed through holes 5 and 7.

Figure 3:
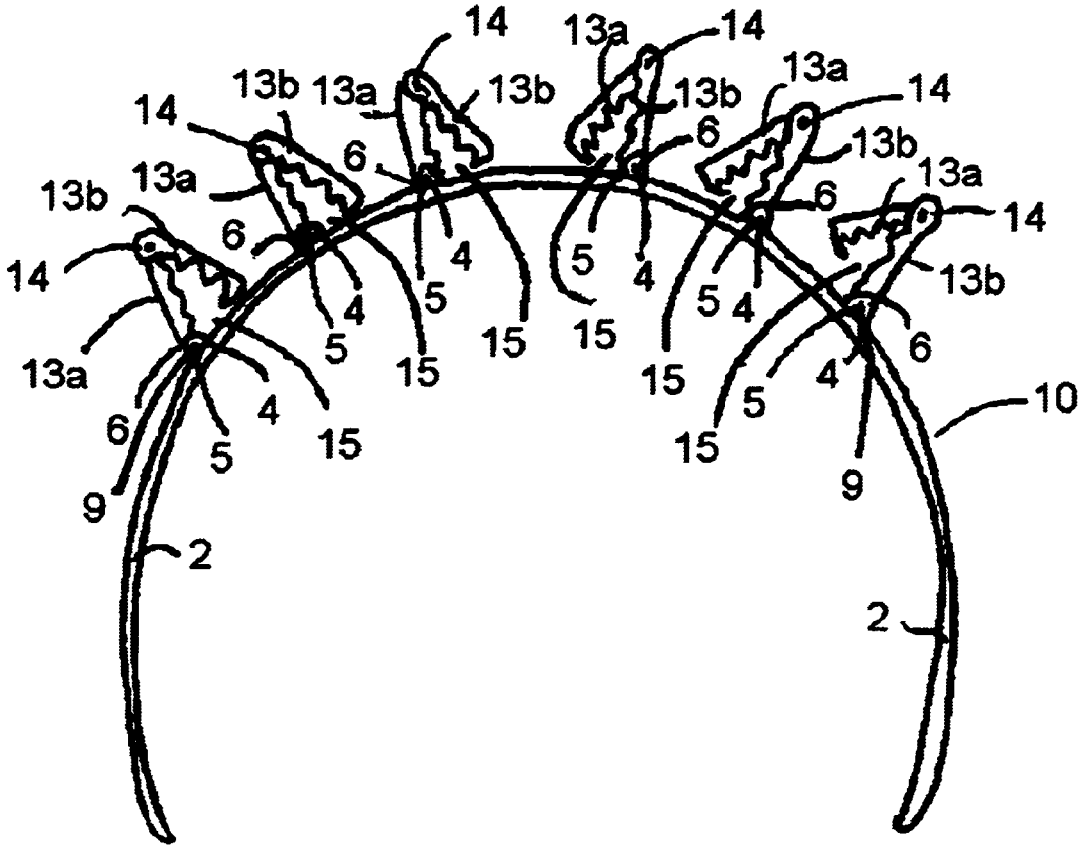
FIG. 3 is a front view of another version of the multiple clip fastener.

In another version 10 of FIG. 3 the clip 3 is formed from two arms 13*a* and 13*b* that are hinged together at 14 and then attached to the band's lugs 4. The hinge 14 bends back toward the band 2 and has fasteners 15 at or near the band 2.

In use of the multiple clip headband fastener FIG. 2 the user places the present invention 1 onto their hair. The user then takes sections of hair in front or behind each clip 3, twists them and places them into the corresponding clip 3 to secure.

Figure 4:
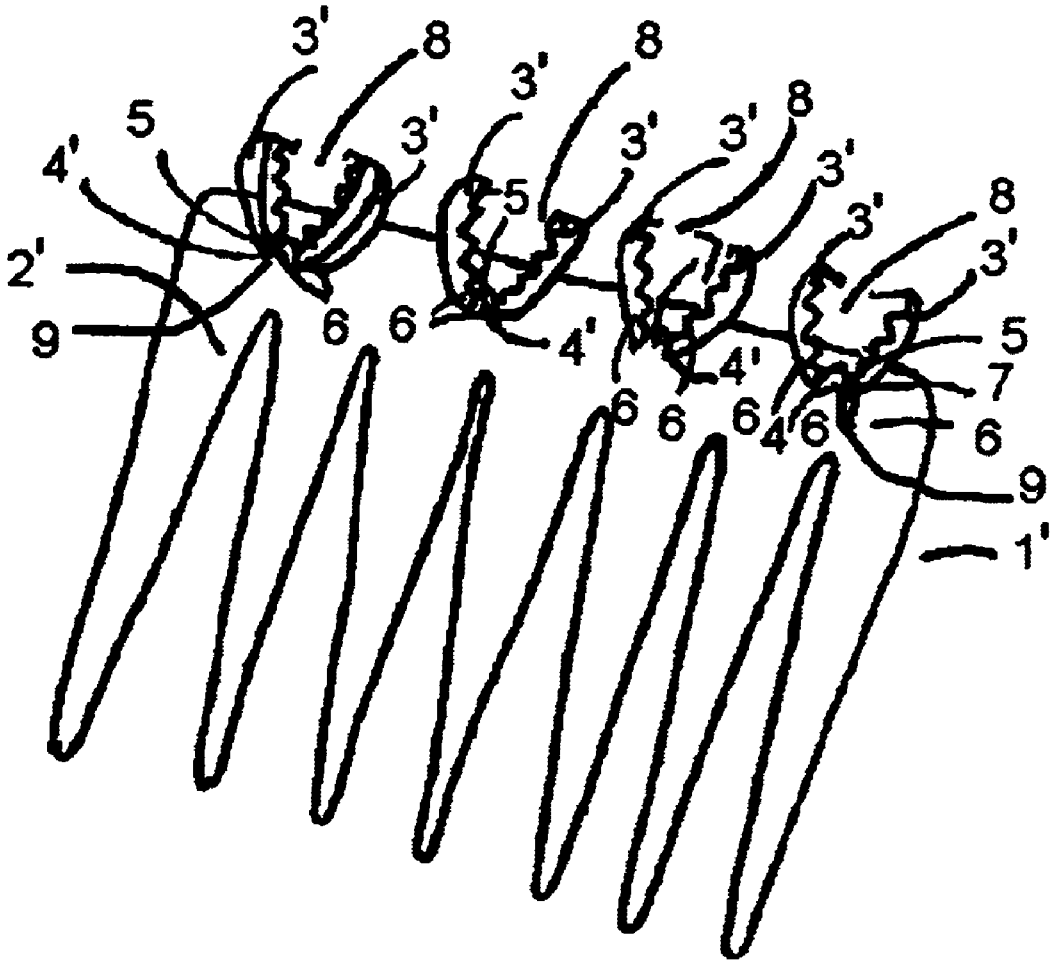
FIG. 4 is a plan view showing another version of the multiple clip fastener using a retaining-comb according to the present invention.

Referring to FIGS. 4 of the accompanying drawings, there is illustrated a multiple clip retaining-comb fastener, generally designated by reference numeral 1, embodying the present invention. The multiple clip retaining-comb fastener 1, comprises a first retaining-comb portion 2 and a plurality of clip portions 3. Each retaining-comb portion 2 has a base 2*b*. Base 2*b* has a plurality of lug portions 4 attached to base 2*b* and each lug portion 4 has a hole 5. Each clip portion 3 has two lug portions 6 that correspond to lugs 4 and each lug 6 has a hole 7 that corresponds to holes 5. The retaining-comb portion 2 and the clip portions 3 are made of plastic.

The clip portions 3 stand substantially perpendicular to the retaining-comb and close at their open end by fasteners 8. In assembly two clip portions 3 are placed on top each of lugs 4 while aligning lugs 6 with lugs 4. A pin 9 is placed through holes 5 and 7.

In use of the multiple clip retaining-comb fastener 1 the user places the comb portion 2 into their hair. The user then pulls sections of hair up and places them in a corresponding clip 3 to secure.

Figure 5:
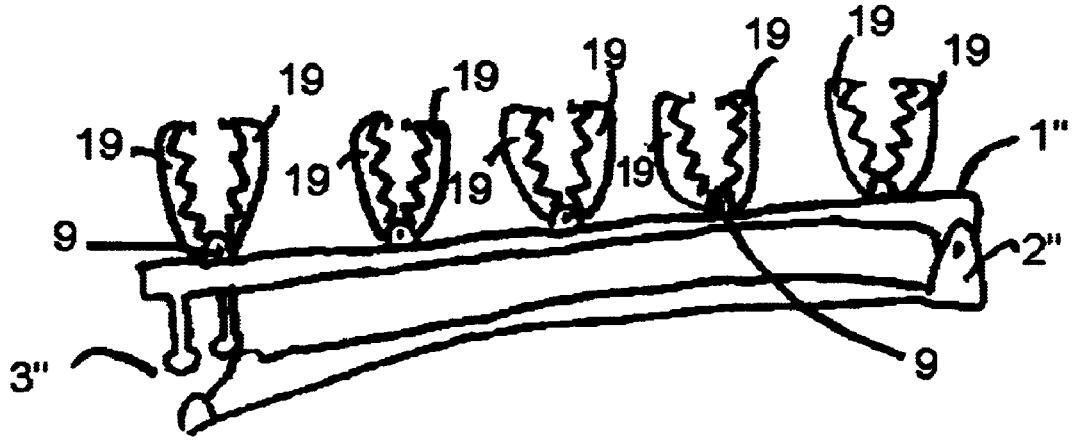
FIG. 5 is a side view of another version of the multiple clip fastener using a barrette.

In another embodiment FIG. 5 a barrette 1 has a plurality of

Clips 4 attached to its top. The preferred embodiment has a basic barrette 1 that is hinged on one side 2 and latched on the other 3. The clips 4 are attached to the top of barrette 1 and are perpendicular to the top of barrette 1.

In use the user attaches the barrette to the user's hair. The user then places sections of hair into each corresponding clip.

Figure 6:
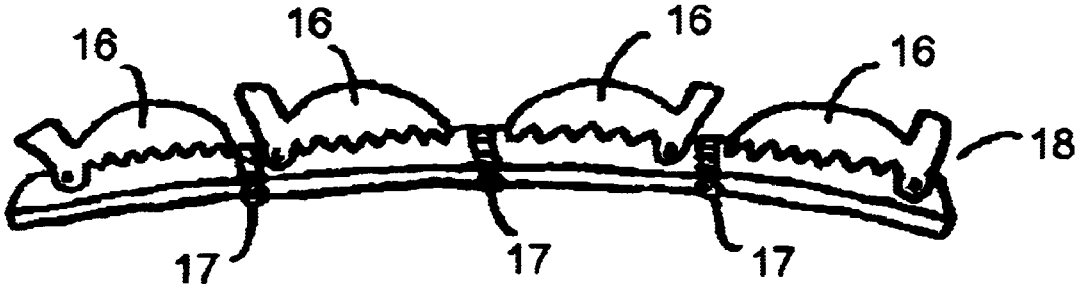
FIG. 6 is a side view of another version of the multiple clip fastener using a plurality of attached clips.

According to another aspect of the present invention FIG. 6 there is provided a multiple clip hair fastener 15 comprising a plurality of clips 16 attached to each other at each clip's bottom leg 17, forming a multiple clip hair fastener of the present invention.

The present invention being thus described, it is obvious that the same may be varied in many ways. For instance, the semicircle band could be a full circle; the hair clips could be any type of hair clip or barrette known in the art as long as they are integral to the top of a band, retaining comb, or barrette, work for their intended use, and are aligned longitudinally; and anyway to integrally attach the clips to the top of the headband, or the bottom leg of individual clips, to each other will work, including snaps, Velcro, etc. Further, ornaments such as flowers can be placed in each clip to decorate the headband. Such variations are not to be regarded as a departure from the spirit and scope of the invention, and all such variations as would be obvious to those skilled in the art are intended to be included within the scope of the following claims.

I claim:

1. A multiple clip fastener for securing head hair sections of a human being and for aligning a plurality of hair clips comprising:

a) a band; and b) a plurality of hair clips integrally attached along the top of said band for securing sections of hair to the top of said band; and c) said hair clips are aligned longitudinally along said band; and d) said clips stand substantially perpendicular to said band while in a closed position;

e) each said clip has a first leg and a second leg;

whereby said band is placed on the head of said human being; said hair sections of said human being are neatly aligned to said band by placing each corresponding said hair section into corresponding said hair clip and said multiple clip fastener is easily removable and reusable.

2. The multiple clip fastener of claim 1, further comprising ornaments on said clips.

3. A multiple clip fastener for securing head hair sections of a human being and for aligning a plurality of hair clips comprising:

a) a barrette; and b) a plurality of hair clips integrally attached to the top of said barrette by attaching means for securing sections of hair to the top of said barrette;

c) said hair clips are aligned longitudinally along said barrette;

d) said clips stand substantially perpendicular to said barrette while in a closed position;

e) each said clip has a first leg and a second leg;

whereby said barrette is attached to said hair of said human being; said hair sections of said human being are neatly aligned to said barrette by placing each corresponding said hair section into corresponding said hair clip and said multiple clip fastener is easily removable and reusable.

4. The multiple clip fastener of claim 3, further comprising ornaments on said clips.

5. A multiple clip fastener for securing head hair of a human being and for aligning hair clips comprising:

a) a hair retaining-comb;

b) a plurality of hair clips integrally attached to the base of said retaining-comb by attaching means;

c) said hair clips are aligned longitudinally across said retaining comb base;

d) said clips stand substantially perpendicular to said retaining comb base while in a closed position;

e) each said clip has a first leg and a second leg;

whereby the comb portion of said multiple clip fastener is placed into the hair of said human being; said hair sections of said human being are neatly placed into each corresponding said hair clip and said multiple clip fastener is easily removable and reusable.

6. The multiple clip fastener of claim, further comprising ornaments on said clips.

7. A multiple clip fastener for securing head hair sections of a human being and for aligning a plurality of hair clips comprising:

a) a plurality of hair clips integrally attached to form a band;

b) each said hair clip has a top leg and a bottom leg; and c) said hair clips are aligned longitudinally; and d) said hair clips are attached to each other between each said clip by attaching means along each said clip's bottom leg;

whereby said clips form a band; said band is placed on the head of said human being; said hair sections of said human being are neatly secured to said band by placing a said hair section into a corresponding hair clip, and said multiple clip fastener is easily removable and reusable.

8. The multiple clip fastener of claim 7 wherein said clips are removably attached.

9. The multiple clip fastener of claim 8, further comprising ornaments on said clips.

10. The multiple clip fastener of claim 7 wherein said clips are attached by hinges.

* * * * *